US010790607B2

(12) United States Patent
Naaman

(10) Patent No.: US 10,790,607 B2
(45) Date of Patent: Sep. 29, 2020

(54) TAMPER RESISTANT PLUG-ABLE SOCKET ADAPTER

(71) Applicant: Laith A. Naaman, Cupertino, CA (US)

(72) Inventor: Laith A. Naaman, Cupertino, CA (US)

(73) Assignee: Laith A. Naaman, Cupertino, CA (US)

( * ) Notice: Subject to any disclaimer, the term of this patent is extended or adjusted under 35 U.S.C. 154(b) by 14 days.

(21) Appl. No.: 16/231,133

(22) Filed: Dec. 21, 2018

(65) Prior Publication Data

US 2019/0131737 A1 May 2, 2019

Related U.S. Application Data

(63) Continuation-in-part of application No. 15/711,665, filed on Sep. 21, 2017, now abandoned.
(Continued)

(51) Int. Cl.

| | |
|---|---|
| ***H01R 4/66*** | (2006.01) |
| ***H01R 13/648*** | (2006.01) |
| ***H01R 13/453*** | (2006.01) |
| ***H01R 24/70*** | (2011.01) |
| ***H01R 31/06*** | (2006.01) |
| ***H01R 13/447*** | (2006.01) |
| ***H01R 24/78*** | (2011.01) |

(Continued)

(52) U.S. Cl.
CPC ..... *H01R 13/4534* (2013.01); *H01R 13/447* (2013.01); *H01R 13/6397* (2013.01); *H01R 24/30* (2013.01); *H01R 24/70* (2013.01); *H01R 24/78* (2013.01); *H01R 25/006* (2013.01); *H01R 31/06* (2013.01); *H01R 13/5213* (2013.01); *H01R 2105/00* (2013.01)

(58) Field of Classification Search
CPC .. H01R 25/006; H01R 31/06; H01R 13/4538; H01R 13/4536; H01R 24/70; H01R 24/78
USPC ..... 439/140–142, 105, 107
See application file for complete search history.

(56) References Cited

U.S. PATENT DOCUMENTS 2,792,561 A * 5/1957 Cohen ..... H01R 31/02 439/652
3,131,013 A 4/1964 Carlson
(Continued)

OTHER PUBLICATIONS

U.S. Appl. No. 16/236,103, Laith A. Naaman, Safety Mechanism for Electrical Outlets, filed Dec. 28, 2018.
(Continued)

*Primary Examiner* — Hae Moon Hyeon
(74) *Attorney, Agent, or Firm* — Polsinelli LLP

(57) ABSTRACT

The present disclosure is directed to tamper resistant outlets (TRO) and adapters that adapt non-TRO compliant electrical sockets to become TRO compliant sockets. Adapters consistent with the present disclosure may include one or more sets of prongs or plug bars that mate with electrical wall outlets or sockets, such that an adapter can be plugged into a wall socket directly. These adapters may cover a non-compliant socket with a structure that provides TRO compliant receptacles. Other surfaces on the TRO adapter may include one or more sets of covers that cover receptacles included in the TRO adapter when a plug is not installed into a respective set of receptacles. Adapters consistent with the present disclosure may adapt sockets that use either two or three prongs. Adapters consistent with the present disclosure may be attached and retained using screws or other protrusions.

19 Claims, 18 Drawing Sheets

Related U.S. Application Data

(60) Provisional application No. 62/399,577, filed on Sep. 26, 2016.

(51) Int. Cl.

| | |
|---|---|
| ***H01R 24/30*** | (2011.01) |
| ***H01R 13/639*** | (2006.01) |
| ***H01R 25/00*** | (2006.01) |
| *H01R 13/52* | (2006.01) |
| *H01R 105/00* | (2006.01) |

(56) References Cited

U.S. PATENT DOCUMENTS

| | | | | | |
|---|---|---|---|---|---|
| 3,775,727 | A * | 11/1973 | Wise | H01R 31/06 | 439/105 |
| 3,985,412 | A * | 10/1976 | Hoffman | H01R 13/648 | 439/105 |
| 3,997,225 | A | 12/1976 | Horwinski | | |
| 4,897,049 | A * | 1/1990 | Miller | H01R 25/006 | 439/365 |
| 4,955,213 | A | 9/1990 | Ohsugi et al. | | |
| 5,383,799 | A | 1/1995 | Fladung | | |
| 5,621,277 | A | 4/1997 | Ricca | | |
| 6,309,248 | B1 | 10/2001 | King | | |
| 7,214,101 | B1 | 5/2007 | Tong | | |
| 7,357,652 | B1 | 4/2008 | Arenas et al. | | |
| 7,695,293 | B1 * | 4/2010 | Sikes | H01R 13/4532 | 439/139 |
| 8,187,011 | B1 * | 5/2012 | Baldwin | H01R 13/4534 | 439/137 |
| 8,864,505 | B2 * | 10/2014 | Chuang | H01R 13/713 | 200/51.02 |
| 2009/0195349 | A1 | 8/2009 | Frader et al. | | |
| 2009/0319207 | A1 | 12/2009 | Koch | | |
| 2011/0216453 | A1 | 9/2011 | Haines et al. | | |
| 2012/0075759 | A1 | 3/2012 | Eaves | | |
| 2014/0030898 | A1 * | 1/2014 | Baldwin | H01R 13/4534 | 439/140 |
| 2014/0094044 | A1 | 4/2014 | Ward | | |
| 2014/0162480 | A1 | 6/2014 | Schutte et al. | | |
| 2014/0342589 | A1 * | 11/2014 | Lin | H01R 13/5213 | 439/142 |
| 2017/0184343 | A1 | 6/2017 | Freer et al. | | |
| 2018/0090870 | A1 | 3/2018 | Naaman | | |
| 2018/0198821 | A1 | 7/2018 | Gopalakrishna | | |
| 2019/0214775 | A1 | 7/2019 | Naaman | | |
| 2020/0158069 | A1 | 5/2020 | Graham et al. | | |

OTHER PUBLICATIONS

U.S. Appl. No. 15/711,665 Final Office Action dated Sep. 25, 2018.
U.S. Appl. No. 15/711,665 Office Action dated Jan. 12, 2018.
U.S. Appl. No. 16/236,103 Office Action dated Jun. 12, 2020.

* cited by examiner

TAMPER RESISTANT PLUG-ABLE SOCKET ADAPTER

CROSS-REFERENCE TO RELATED APPLICATION

The present application is a continuation-in-part and claims the priority benefit of U.S. patent application Ser. No. 15/711,665 filed on Sep. 21, 2017, which claims the priority benefit of U.S. provisional patent application 62/399,577 filed on Sep. 26, 2016, the disclosures of which are incorporated by reference.

BACKGROUND OF THE INVENTION

1. Field of the Invention

The present disclosure is directed to providing a tamper resistant socket. More specifically, the present disclosure is directed to adapting electrical sockets that are not tamper resistant to being tamper resistant.

2. Description of the Related Art

In recent years, an increasing number of States in the U.S. have adopted 2008NEC (National Electrical Code) standard which requires use of Tamper Proof Outlet (TRO) in new buildings. These outlets have a plastic (or other electrically insulating material) screen covering the Live and Neutral outlets to protect against children inserting metal objects in powered outlets. When a plug is inserted in a tamper resistant socket, it would push against a spring loaded mechanism that pulls the screen down o or pushes it in a sideways direction, thus allowing the insertion of the Live and Neutral blades. When the plug is pulled, as soon as the blades disengage from their outlets, the screen jumps back up. Customers will have to replace their existing wall sockets with a TRO and while such sockets are not expensive, replacing existing wall sockets is not always straightforward. Customers will have to turn the power off, remove the old socket and wire the new TRO socket correctly.

The prior art in this field as depicted in the patents referenced above can be divided into three categories: One the deals with design of and construction of the mechanism inside the wall socket to make it tamper resistant teaching different methods for such implementation. Not surprisingly these patents were assigned to major socket manufacturers such as Leviton and Hubble. The second category is one where the patents pertain to covers of wall sockets to make them tamper resistant. The third category is for patents pertaining to socket plug locked combination to prevent separation if the plug is yanked but prevent partial disengagement, thereby exposing live conductors.

SUMMARY OF THE CLAIMED INVENTION

The presently claimed invention relates to an electrical adapter that can convert older electrical sockets that do not include a tamper resistant feature to include the tamper resistant feature. The electrical adapter may include a first and a second electrically conductive protrusion that protrude from a first surface of the adapter and that mate with respective neutral and electrically active contacts of an electrical socket. The adapter may include a first formed metallic piece configured to receive an electrically conductive connector. The adapter may also include a receptacle disposed on a second surface that includes holes can receive an electrical plug that includes a neutral connection, an electrically active connection, and a grounding pin. The receptacle may include a cover that moves (flexibly covering) at least a hole associated with an electrically energized (live or 'hot') plug bar. When assembled, the first formed metallic piece may aligned between a cover of the electrical socket and the adapter, the electrically conductive connecting protrusion electrically connects to the first formed metallic piece and physically connects the first formed metallic piece to the electrical socket. In such an instance the first and second electrically conductive protrusions respectively mate to the neutral contact and to the electrical active contact. The ground pin of the electrical plug electrically connects to the first formed metallic piece when the electrical plug is received by the adapter and when the adapter is received by the electrical socket.

DETAILED DESCRIPTION

The current disclosure relates to field of electrical adapters with receptacles may be disposed on one side and a plug on the other. Such adapters are common as travel plug adapters where the receptacles are designed to accept plugs designed for one market, e.g., United Kingdom (U.K.) or Europe and plug into a wall socket of another market, e.g. United States (U.S.). The current disclosure includes adapters that may plug into conventional legacy wall sockets with or without a ground pin and turns it to a Tamper Resistant Outlet (TRO) that is compliant with National Electrical Manufacturers Association (NEMA) standards.

The invention may be a duplex (2 gang) tamper resistant socket adapter pluggable into a regular wall socket (NEMA-1 or NEMA-5). The plug terminals provide alternating current (AC) power and grounding to the socket outlets.

On embodiment for realizing this invention include a case that holds a TRO compatible socket that plugs into an older non-TRO compliant socket. Another embodiment includes an adapter that uses simple inexpensive parts that adapt a non-TRO compliant socket into a TRO compliant socket. The present disclosure may be used to adapt NEMA-5 (grounded) wall sockets and NEMA-1 (ungrounded wall sockets) into TRO compliant socket.

As such, tamper resistant outlets (TRO) or TRO outlet adapters may be assembled as a new part or may be made by adapting or modifying a pre-existing power outlet wall socket. TROs or TRO outlet adapters may include creating new outlets/inlets-plug bar combinations, may include modifications to a plastic enclosure to accommodate the plug bars and connections that may be used to electrically connect to conductors in a wall socket outlet.

Figure 1:
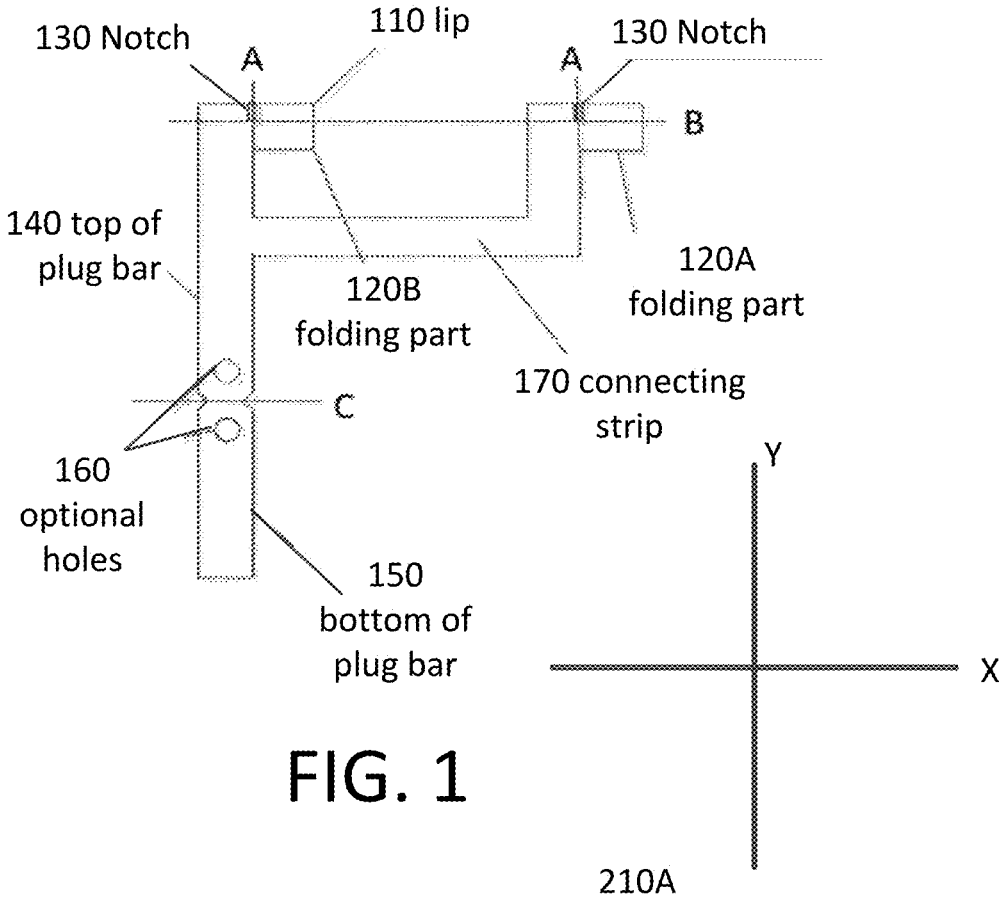
FIG. 1 illustrates a flat piece of metal of shape that may be folded.

FIG. 1 illustrates a flat piece of metal of shape that may be folded. The flat metal piece in FIG. 1 includes notches 130, folding lines A, folding part 120A, folding part 120B, connecting strip 170, bottom part of plug bar 150, bottom part of plug bar 140, folding line B, folding line C, and optional holes 160. Note that parts 120A and 120B may be folded along folding lines A and along folding line B to form features that extend in a direction away from a plane surface identified by axis X and Y shown in FIG. 1. A plug bar may be formed by folding the plug bar bottom piece 150 along folding line C. Plug bar bottom piece may be folded such that it makes contact with the plug bar top piece 160. The folding of the flat metal piece of FIG. 1 may form a plug bar that is capable of being received by an electrical socket and may be used to form electrically conductive parts or lips that may form electrical connections when installed in an assembly or a TRO adapter. Connecting strip 170 may simply be a piece of the flat metal piece that electrically connects plug bar pieces of an electrical plug with folding parts 120A and 120B. The flat metal piece of FIG. 1 may have been made from flat metal stock that has been cut or stamped into the shape shown in FIG. 1. Such cutting or stamping of metal stock may be performed by methods known in the art of metal forming.

Figure 2:
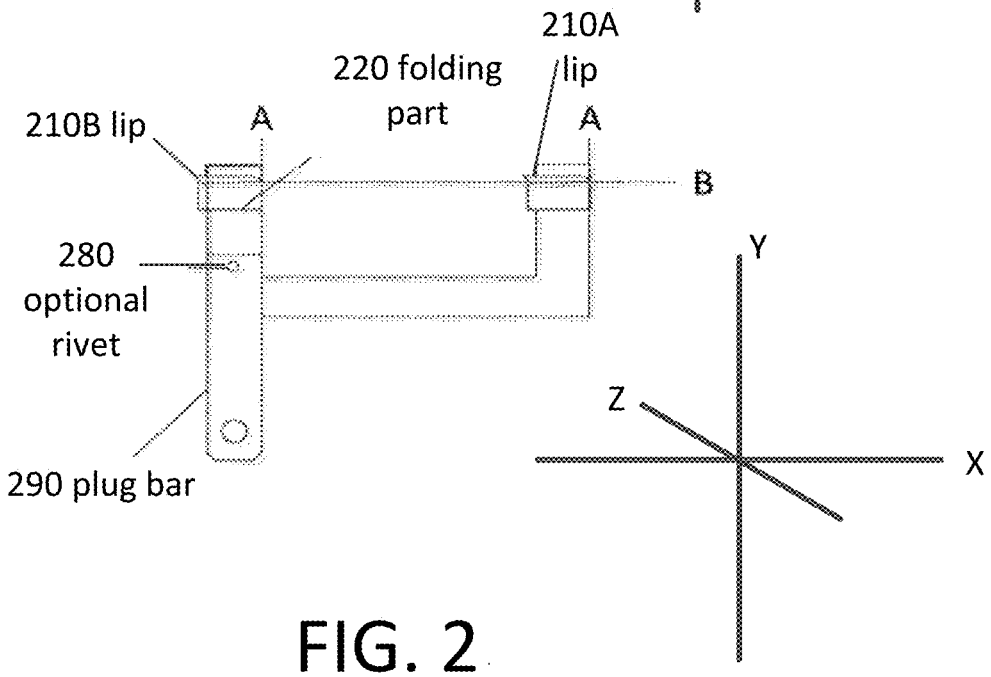
FIG. 2 illustrates the metal piece of FIG. 1 after that metal piece has been folded.

FIG. 2 illustrates the metal piece of FIG. 1 after that metal piece has been folded. FIG. 2 includes lip 210B and lip 210A that have been formed by folding the metal piece of FIG. 1 along folding lines B and A. FIG. 2 also includes axes X, Y, and Z in three dimensional space. Lips 201A and 210B extend in a direction that is not perpendicular to a plane identified by axes X and Y. Plug bar 290 has been formed by folding the metal piece of FIG. 1 along folding line C as described above. Plug bar 290 may also include optional rivet 280. Rivet 280, when used may help stiffen plug bar 290 after plug bar 290 has been formed by folding the metal piece of FIG. 1.

Figure 3A:
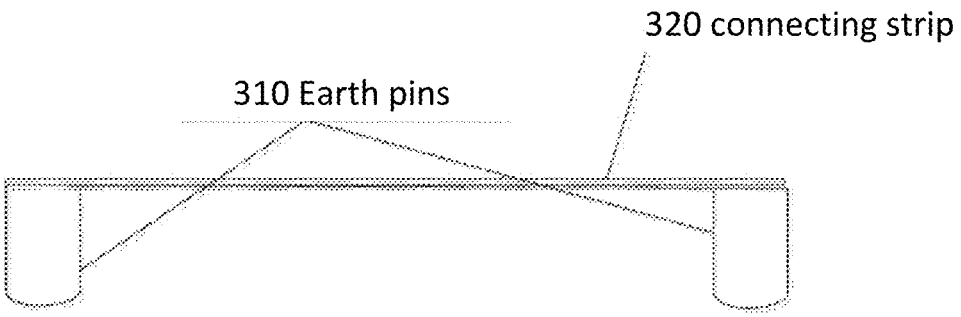
FIGS. 3A and 3B illustrates other metallic pieces that may be used in a tamper resistant outlet (TRO) or TRO adapter consistent with the present disclosure.
Figure 3B:
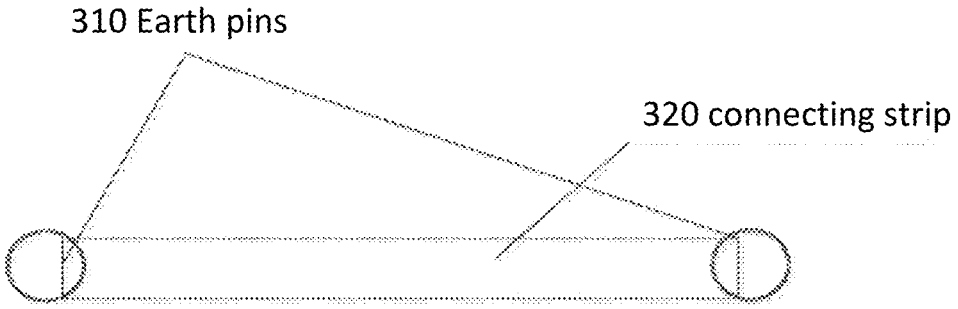

FIGS. 3A and 3B illustrates other metallic pieces that may be used in a tamper resistant outlet (TRO) or TRO adapter consistent with the present disclosure. The metallic pieces of FIG. 3A or 3B may have been formed by folding flat metal pieces. FIGS. 3A and 3B each include connecting strip 320 and Earth pins 310, where connecting strip 320 electrically connects Earth pins 310 that point in a direction that may be perpendicular to connecting strip 320. Note that Earth pins 310 may be flat or may be formed into a circular shape. Earth pins 310 may be used in a TRO or a TRO adapter consistent with the present disclosure where they may provide an Earth ground to socket or electrical plug received by a TRO or TRO adapter.

Figures 4A, 4B:
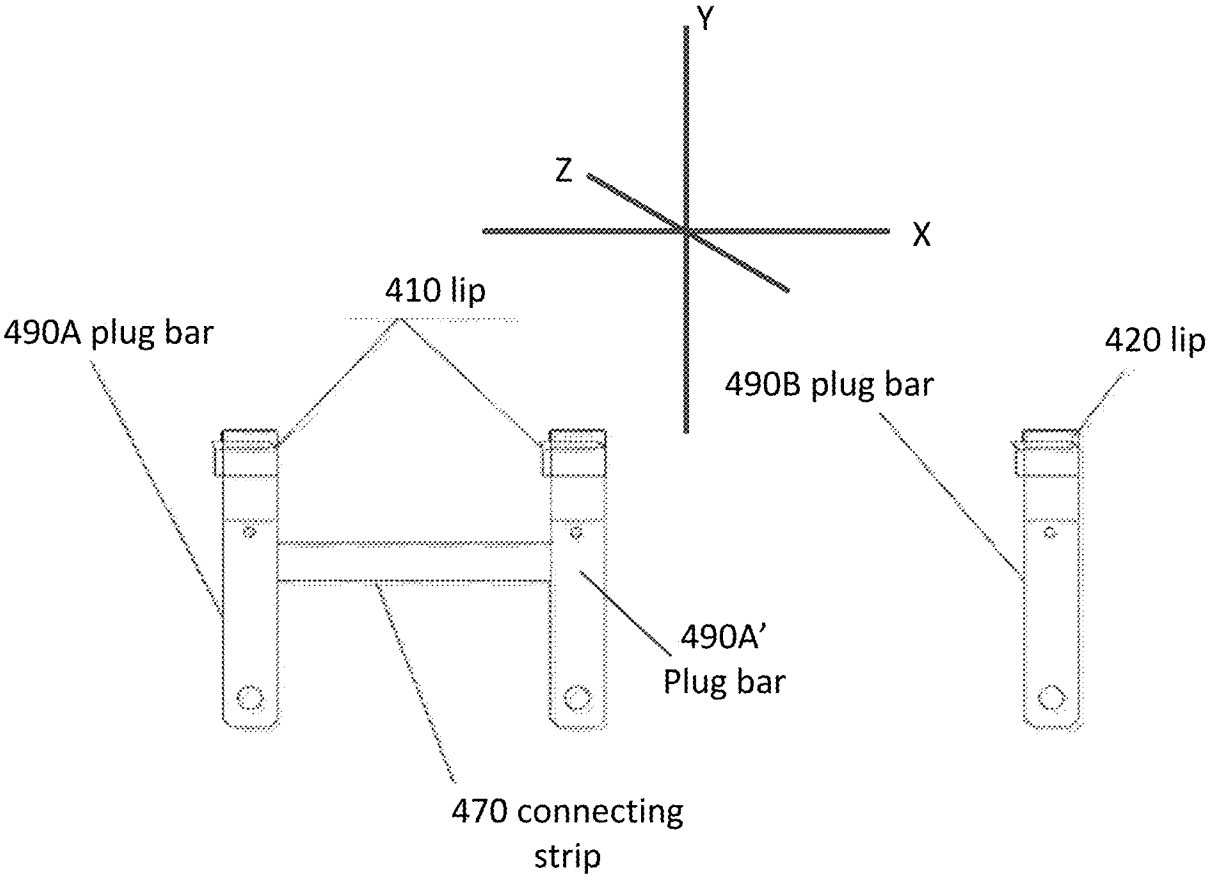
FIG. 4A illustrates plug bars and formed lips in a first configuration that may have been formed by processes that may include cutting, stamping, or folding of flat metal pieces as described in respect to FIG. 1 and FIG. 2.
FIG. 4B illustrates a single plug bar with a formed lip in a second configuration that may have been formed by cutting, stamping, or folding flat metal pieces.

FIG. 4A illustrates plug bars and formed lips in a first configuration that may have been formed by processes that may include cutting, stamping, or folding of flat metal pieces as described in respect to FIGS. 1 and 2. FIG. 4A includes two electrically connected plug bars 490A and 490A', where plug bars 490A and 490A' are electrically connected by connecting strip 470. FIG. 4A also include axes X, Y, and Z in three dimensional space. Note that lips 410 are similar to the lips of FIG. 2 and extend in a direction that point away from a plane identified by axis X and Y. The plug bars 490A and 490A' may be used in a TRO or TRO adapter consistent with the present disclosure where they may be used to form connections with a live power contact or with a neutral connector.

FIG. 4B illustrates a single plug bar with a formed lip in a second configuration that may have been formed by cutting, stamping, or folding flat metal pieces. FIG. 4B includes plug bar 490B and lip 420.

Figure 5A:
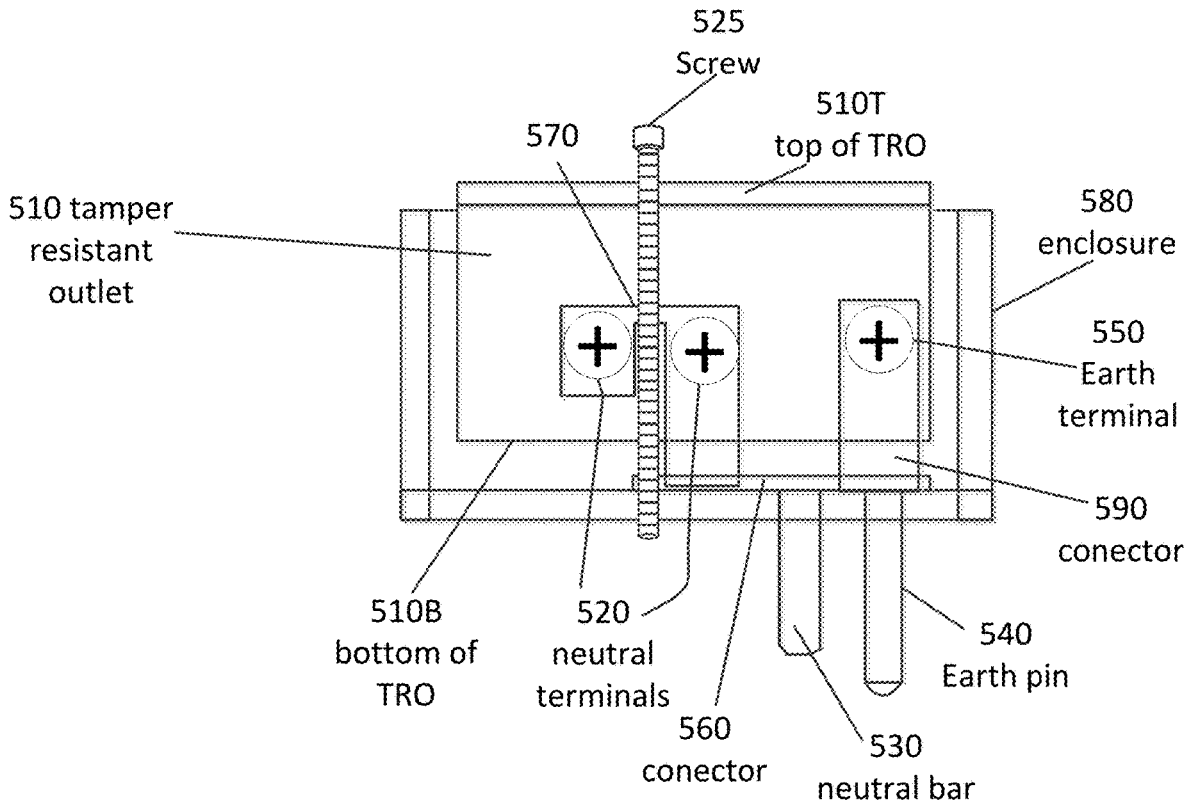
FIG. 5A illustrates a standard TRO that has been adapted to plug into an existing electrical receptacle/socket.

FIG. 5A illustrates a standard TRO that has been adapted to plug into an existing electrical receptacle/socket. TRO 510 of FIG. 5A may be assembled within enclosure 580 when a TRO adapter is made. TRO 510 includes a top portion 510T, a bottom portion 510B, neutral terminals 520, connecting piece 570, and Earth terminal 550. The TRO adapter of FIG. 5A may also include connector 560, neutral bar 530, and Earth pin 540. Note that connecting portion 570 may electrically connect neutral terminals 520 to each other, to connector 560, and to neutral bar 530. Earth Pin 540 may also be connected to Earth terminal 550 by connector 590.

Neutral bar 530 and Earth pin 540 may be plugged into a conventional electrical wall socket after a screw that holds a cover (not illustrated in FIG. 5A) on the electrical wall socket is removed. In such an instance, such a cover may also be removed before the TRO adapter of FIG. 5A is plugged into the wall socket. Next screw 525 may be used to physically secure/connect the TRO adapter of FIG. 5A to the wall socket. As such the TRO adapter of FIG. 5A may adapt a non-TRO compatible wall socket into a TRO compatible wall socket without having to remove wires from the existing non-TRO compatible wall socket when that non-TRO compatible socket is replaced with a TRO compatible wall socket. In such an instance, a person connecting the TRO adapter would not have to turn power off to the wall socket when converting their wall sockets to TRO compatible wall sockets. Note that the TRO adapters consistent with the present disclosure will also include one or more live power bars that plug into an existing wall socket.

Figure 5B:
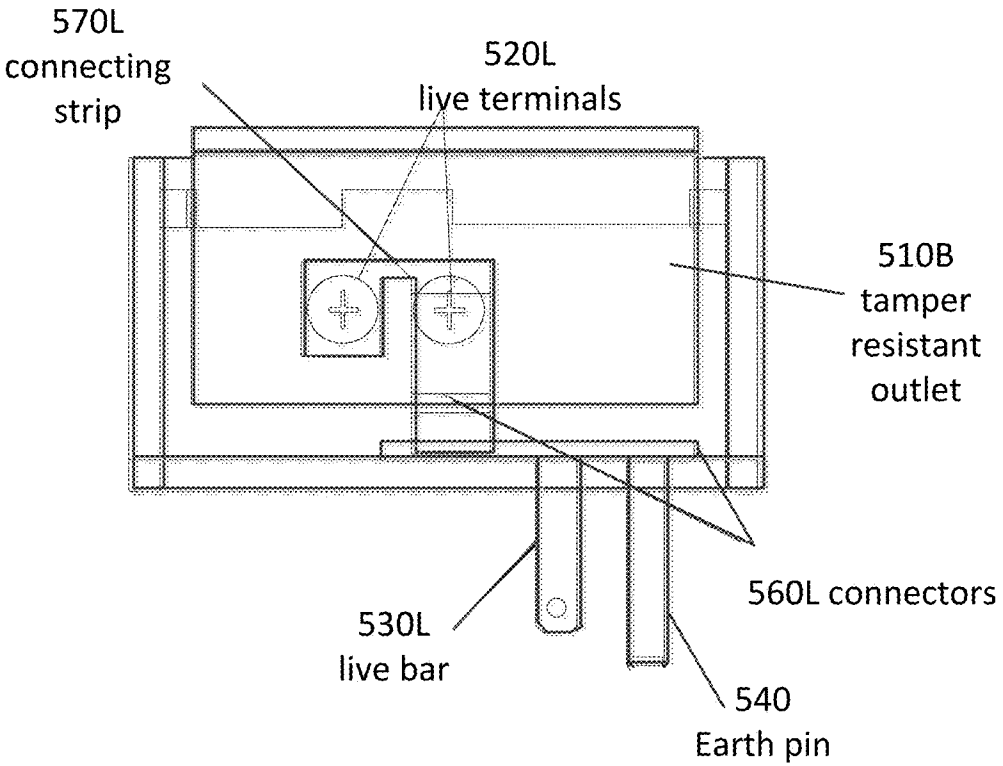
FIG. 5B illustrates a second exemplary TRO adapter consistent with the present disclosure.

FIG. 5B illustrates a second exemplary TRO adapter consistent with the present disclosure. The TRO adapter of FIG. 5B is similar to the TRO adapter of FIG. 5A, it includes TRO 510B, live terminals 520L that may be connected by connecting strip 570L, connectors 560L, live bar 530L, and Earth pin 540. Connector 560L may electrically connect connecting strip 570L and live terminals 520L to live bar 530L. In certain instances, connectors like 560L may be or include a printed circuit board (PCB) that includes conductors that make electrical connections. Such connectors may also be used to connect Earth pin 540 to Earth or ground connectors in TRO socket 510B. The TRO adapter of FIG. 5B may be inserted into an existing wall socket with adapting that wall socket to be TRO compliant.

Figure 6:
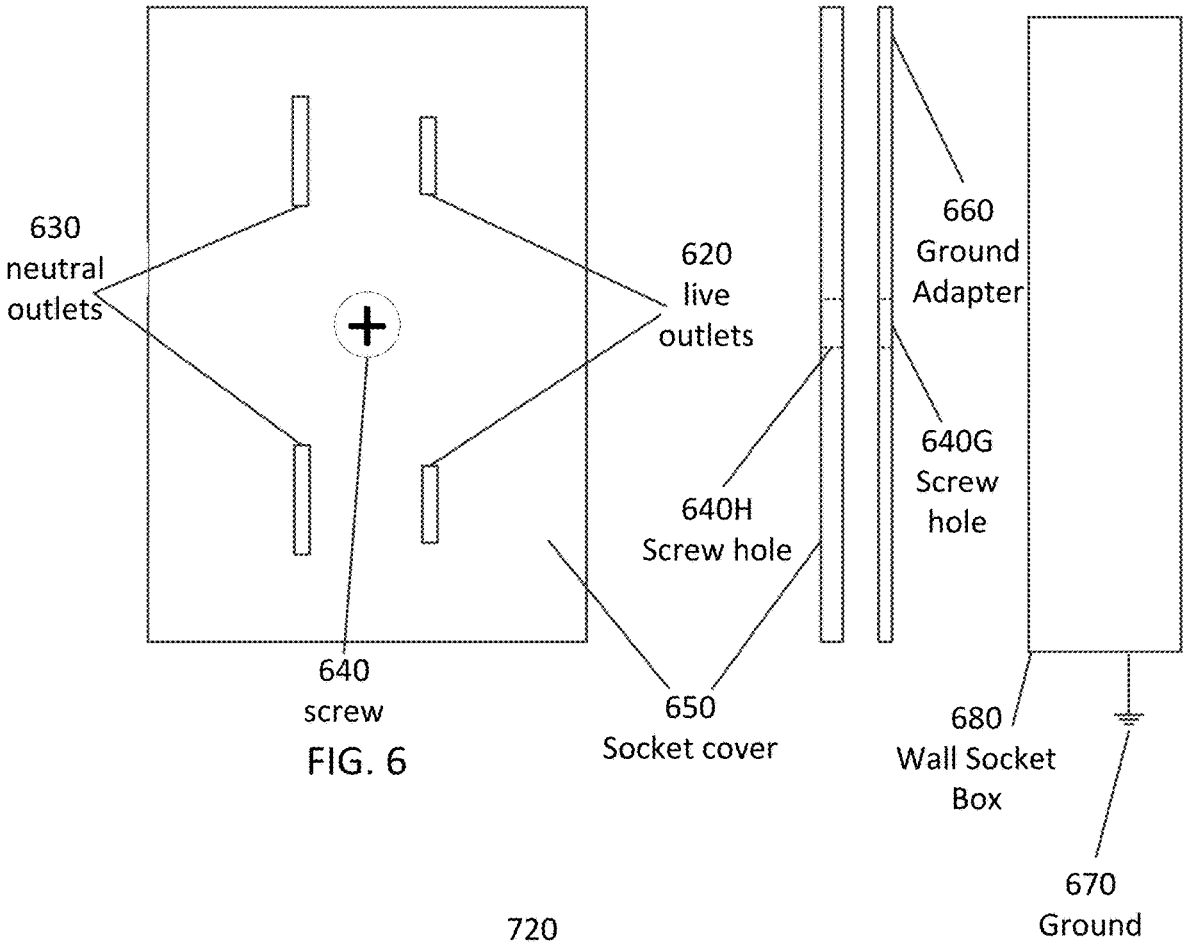
FIG. 6 illustrates a non-TRO compliant wall socket.

FIG. 6 illustrates a non-TRO compliant wall socket. The wall socket of FIG. 6 may be a NEMA-1 compatible wall socket and may include neutral outlets 630, live outlets 620, socket cover 650, and screw 640. Note that socket cover 650 may be removed with screw 640 is removed from the non-compliant wall socket of FIG. 6. After screw 650 is removed a TRO adapter may be attached and electrically connected to neutral outlets 630 and live outlets 620 of FIG. 6. A ground contact may be accessed via screw 640 and ground adapter 660 that may be connected to ground 670. Ground 670 may be a wire or be a formed metal piece that connects to Earth ground. Grounding adapter may include screw hole 640G to which screw 640 may attach.

Note that screw 640 and socket cover 650 may be removed from a non-TRO compliant socket and ground adapter 660 may be connected to ground 670 after which socket cover 650 and ground adapter 660 may be connected using screw 640 such that screw 640 can be connected to an Earth ground. Ground connection 670 may be electrically connected to Earth ground when ground adapter 660 physically contacts a grounded wall socket box 680 that contains a NEMA compatible wall socket. Commonly, such wall socket boxes are connected to Earth ground to comply with electrical codes. One of ordinary skill in the art would understand that wall socket boxes like wall socket box 680 commonly are made of metal and contain electrical outlets to which electrical plugs may be plugged into.

Figure 7:
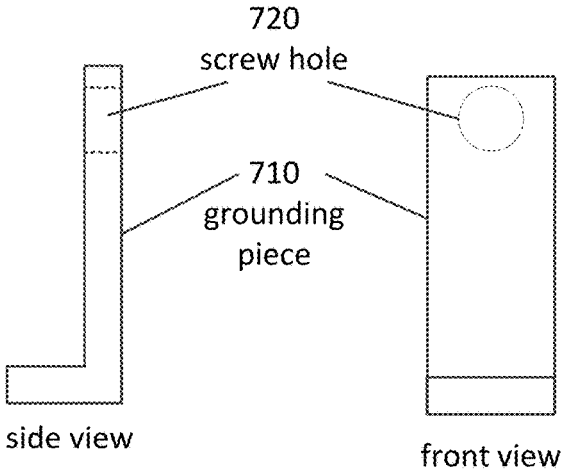
FIG. 7 illustrates a grounding piece that may be included in an assembly when a socket is adapted to be a TRO compliant socket.

FIG. 7 illustrates a grounding piece that may be included in an assembly when a socket is adapted to be a TRO compliant socket. Grounding piece 710 may have been made from a flat metal piece that was stamped, cut, and/or formed. Note that grounding piece 710 includes screw hole 720. FIG. 7 includes a side view and a front view of grounding piece 710. Grounding piece 710 may be assembled into a sub-assembly using parts illustrated in FIG. 6, with socket cover 650, grounding piece 660, and with screw 640, for example. In such an instance, grounding piece 710 may be placed on an outer surface of socket cover 650, where screw 640 connects grounding piece 710 to ground adapter 660 with screw 640. Note that FIG. 14 illustrates such a connection. The socket of FIG. 7 may be a NEMA-1 socket type that does not include a receptacle for a ground connection as it is a two pronged outlet/socket and not a three pronged outlet/socket.

Figure 8A:
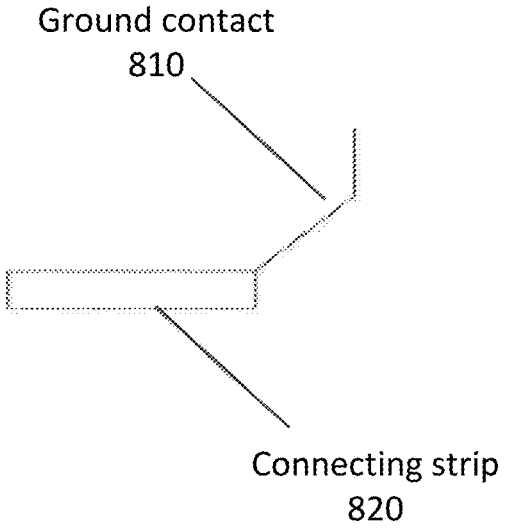
FIG. 8A illustrates a grounding contact that can be formed from a flat metal piece illustrated in FIG. 8B.
Figure 8B:
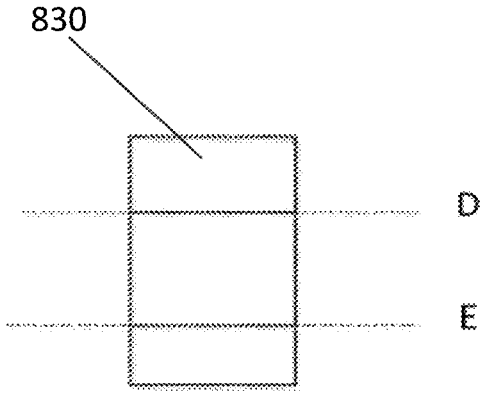

FIG. 8A illustrates a grounding contact that can be formed from a flat metal piece illustrated in FIG. 8B. Note that grounding piece 810 includes connecting strip 820. Note that grounding piece 810 may have been formed by folding the flat metal piece 830 of FIG. 8B along lines D and E. Connecting strip 820 may also be connected to an Earth ground.

Figure 9:
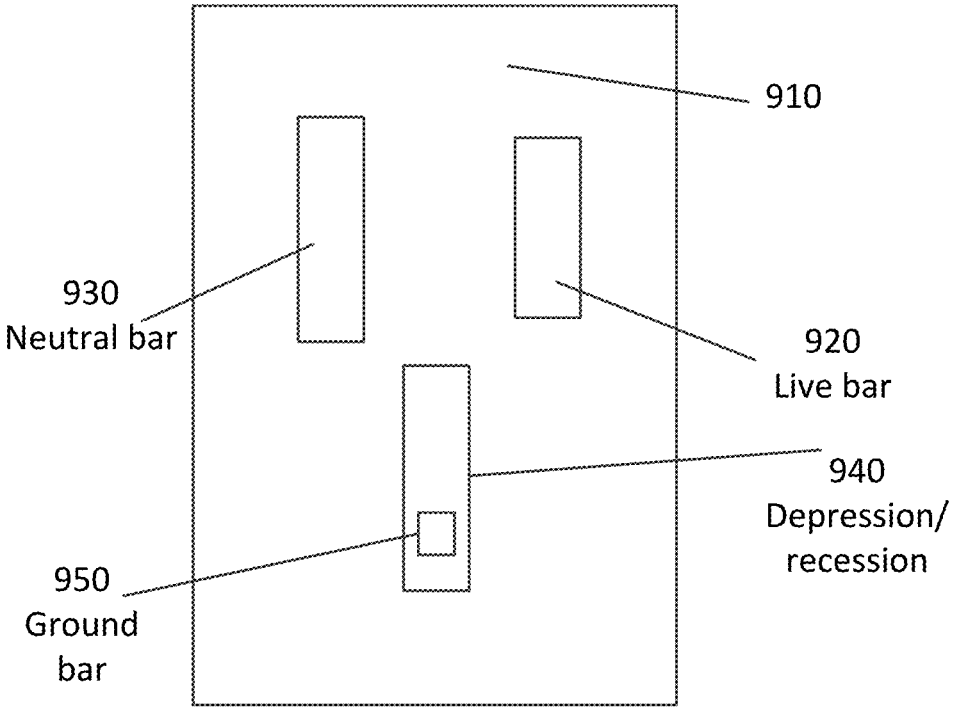
FIG. 9 illustrates a back side portion of TRO adapter consistent with the present disclosure.

FIG. 9 illustrates a back side portion of TRO adapter consistent with the present disclosure. Adapter 910 may include live bar 920, neutral bar 930, ground bar 950, and depression/recession 940. Live bar 920, neutral bar 930, and neutral bar 930 may plug into a conventional wall socket when adapting that wall socket to be TRO compliant. In such an instance a front side (not illustrated in FIG. 9) of the TRO adapter of FIG. 9 may include covers that cover a live bar receptacle and a neutral bar receptacle when a plug is not inserted in that front side of the TRO adapter.

Figure 10:
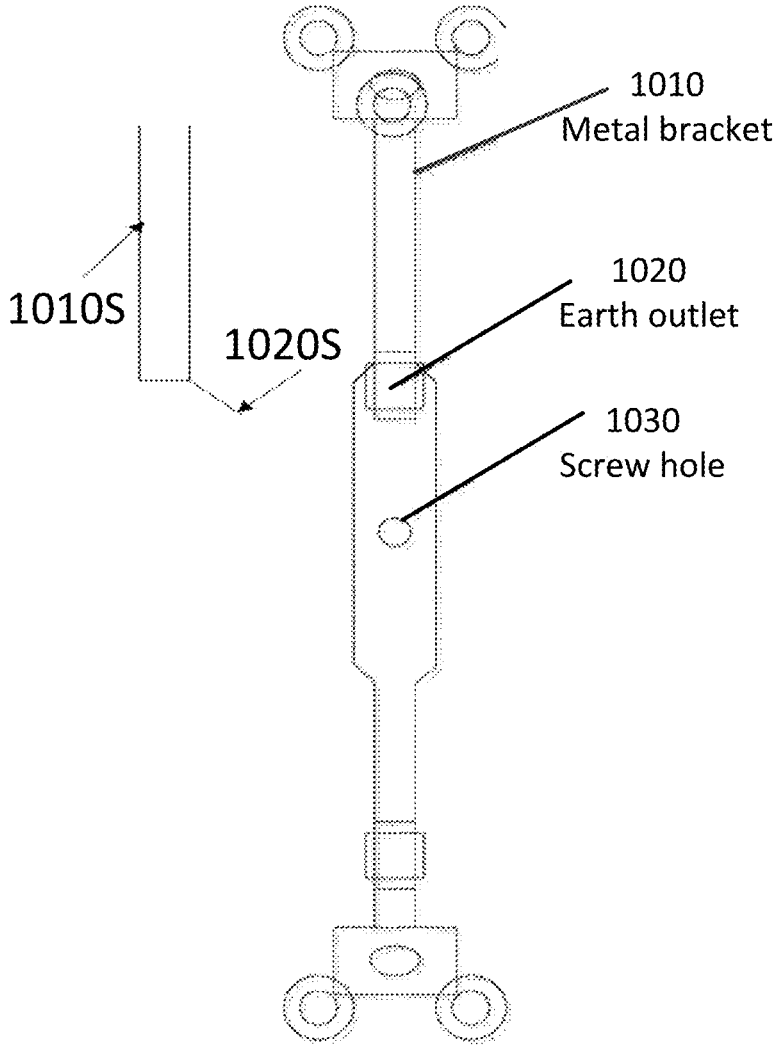
FIG. 10 shows a metal bracket that may be used to provide an Earth ground connection to an adaptor consistent with the present disclosure.

FIG. 10 shows a metal bracket that may be used to provide an Earth ground connection to an adaptor consistent with the present disclosure. Note that metal bracket 1010 houses the Earth outlets 1020 (ground contact) and secures the socket to the wall and secures a face plate associated with the adaptor with a screw through a screw hole 1030. Note that the ground adapter 660 of FIG. 6 may be shaped like the metal bracket 1010 of FIG. 10 and the Earth ground may be provided via an electrical connection at a grounded wall socket box. Metal bracket 1010/1010S when electrically connected to a grounded wall socket box may be used to provide a ground connection to a ground pin of a plug via Earth outlet contact 1020/1020S. Note that items 1010S and 1020S is a partial side view of metal bracket 1010 that may include a metallic or copper contact 1020S that a ground pin of a plug may electrically connect to in a manner similar to the Earth pin 1415 of plug 1410 of FIG. 14 A/B.

Figure 11:
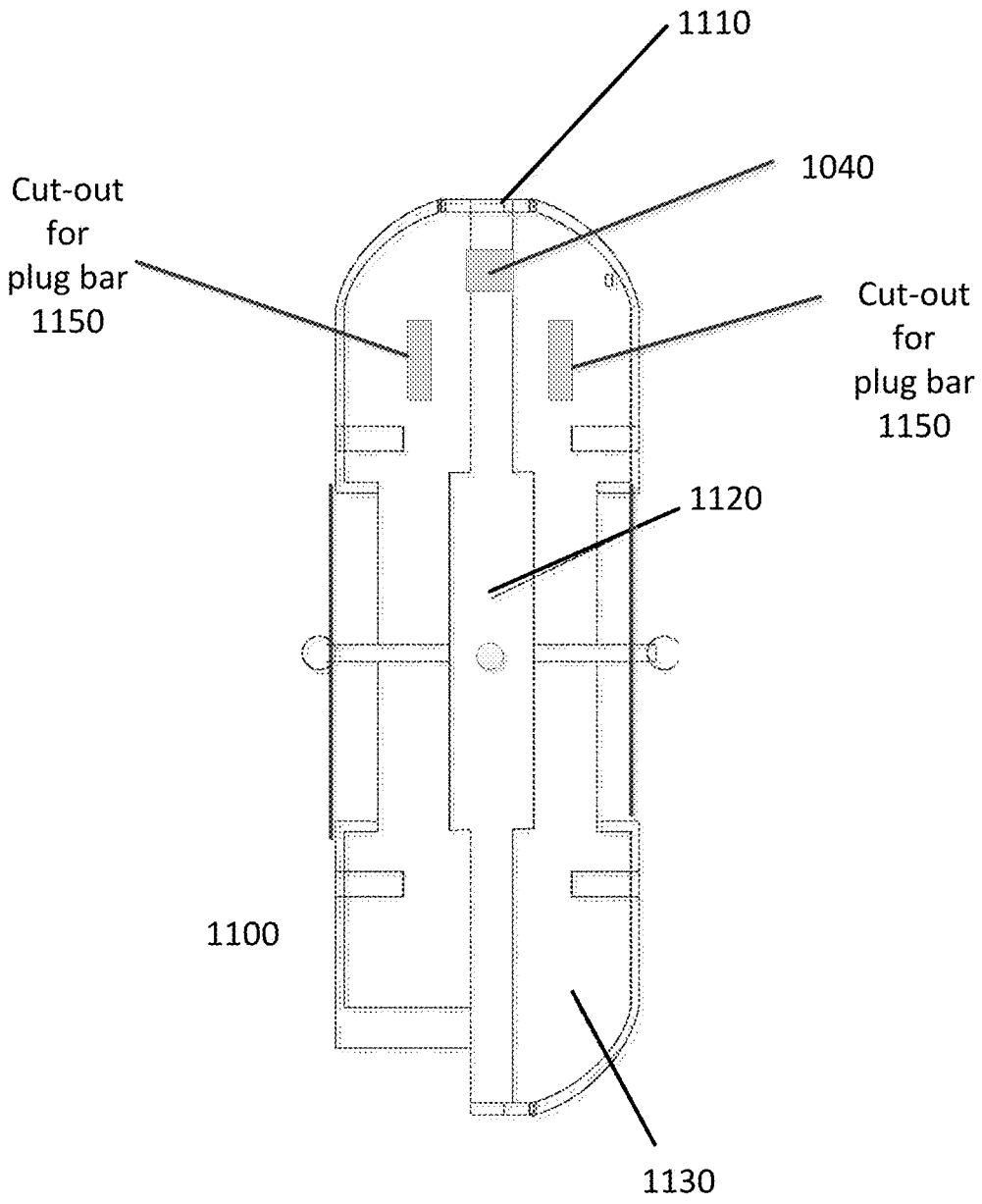
FIG. 11 shows a bottom part that may be used in an adaptor consistent with the present disclosure.

FIG. 11 shows a bottom part that may be used in an adaptor consistent with the present disclosure. The bottom part 1100 of FIG. 11 may be included in an internal portion of a socket adapter consistent with the present disclosure. Bottom part 1100 of FIG. 11 may include a plastic portion 1110, an Earth ground metal bracket 1120, a metallic portion that may be connected to live power via a plug bar (like the plug bar 1340B of FIG. 13 or 490B of FIG. 4B), cut-outs for plug bars 1150, and a point 1040 where a ground pin may contact metal bracket 1120 when a plug is plugged into a socket adapter. The bottom part of FIG. 11 may also be Earth grounded by metal portion 1120 being electrically connected to a wall socket box.

Figure 12:
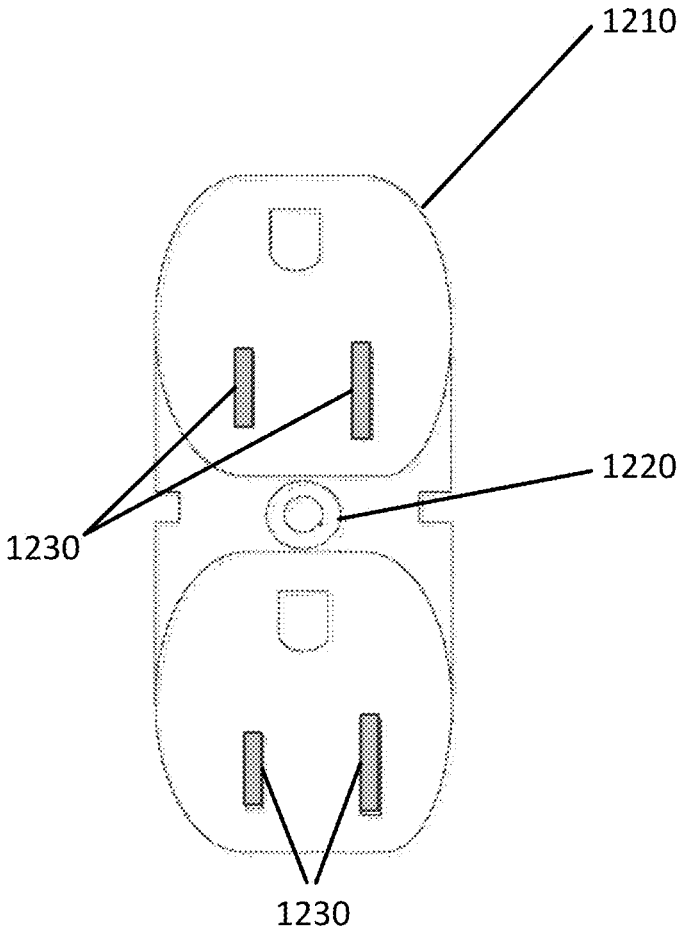
FIG. 12 shows the top part of a tamper resistant outlet (TRO).

FIG. 12 shows the top part of a tamper resistant outlet (TRO). FIG. 12 includes TRO 1210 and screw hole for the wall plate 1220 where neutral and live plug receptacles are covered with a retractable gray covers 1230. These retractable covers 1230 may be retracted under when a plug is inserted in the TRO socket based on both a neutral and a live plug bar of a plug being inserted into the TRO socket at the same time.

Figure 13:
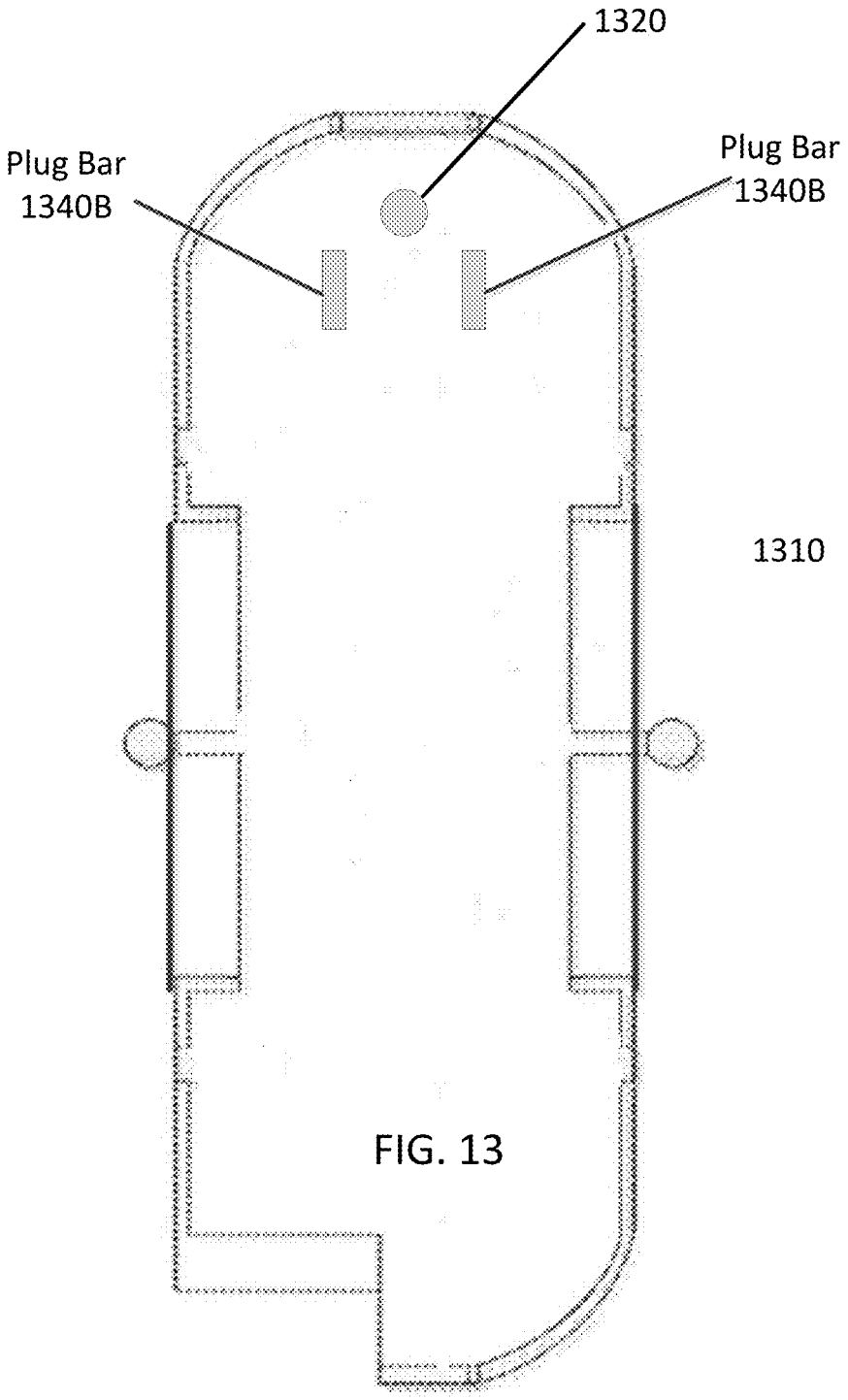
FIG. 13 illustrates an outside portion of an adapter consistent with the present disclosure.

FIG. 13 illustrates an outside portion of an adapter consistent with the present disclosure. The adapter 1310 of FIG. 13 may include plug bars 1340B that may be used to attach adapter 1310 to a wall socket. In such an instance plug bars 1340B may be used to provide live and neutral connections to the bottom portion of FIG. 11. For example, when adapter 1310 is attached to a wall socket, a live plug bar of adapter 1310 may electrically connect the metallic portion 1130 to a live connection. Furthermore, when the electrical plug of an appliance is received by the plug bar cutouts 1150 of FIG. 11, that electrical appliance plug may receive electrical power by a live pin of that appliance plug touching metallic portion 1130 of FIG. 13. Additionally adapter 1310 of FIG. 13 may include a ground pin 1320. As such, the bottom part 1100 of FIG. 11 may receive a plug from an appliance and the adapter 1310 may provide that plug with live and neutral connections when adapter 1310 is plugged into a wall socket.

Figure 14A:
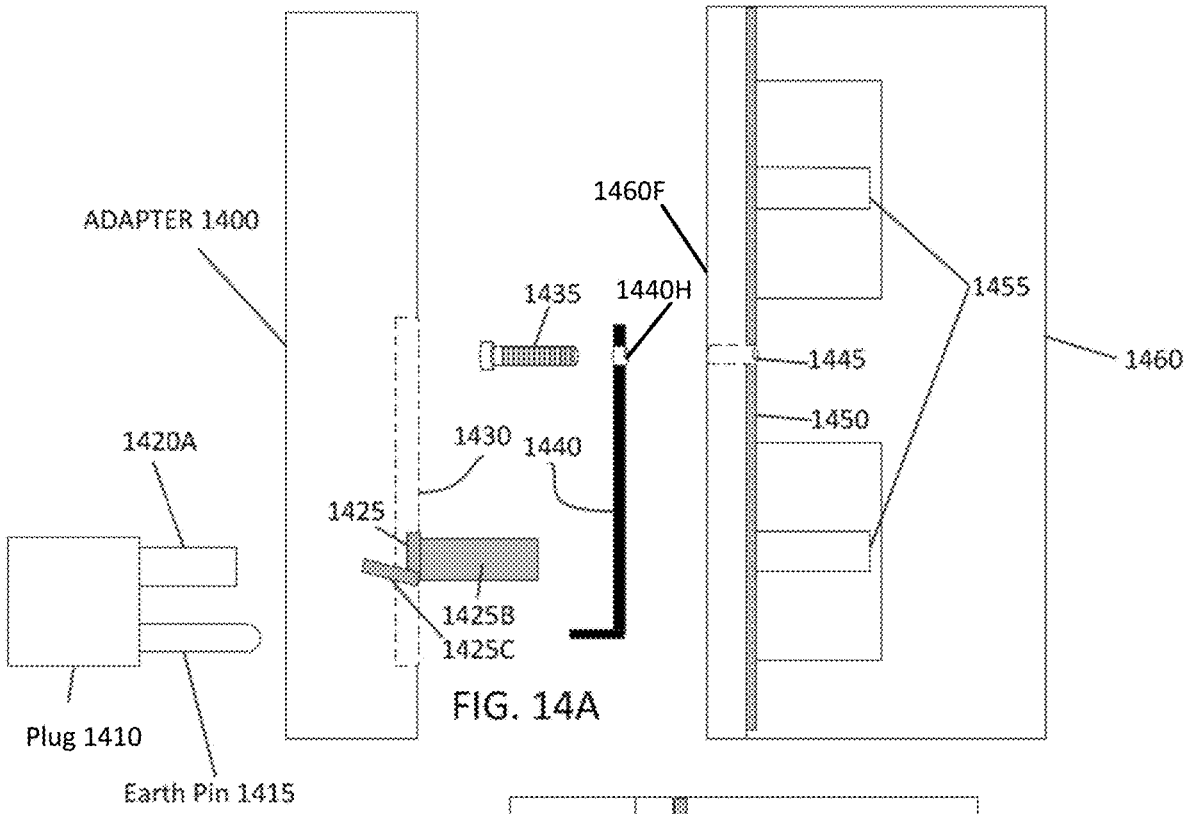
FIGS. 14A and 14B illustrate an exemplary adapter that can connect to a wall socket.
Figure 14B:
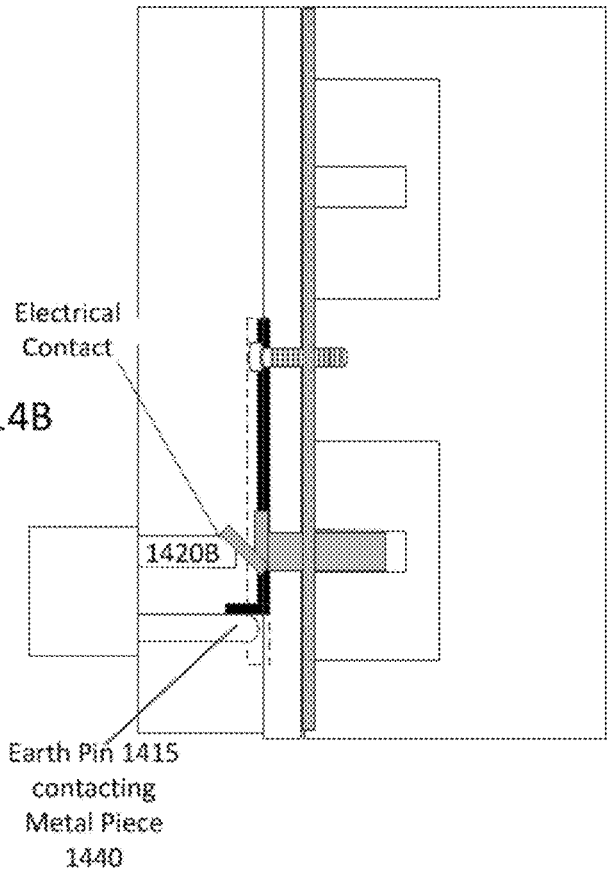

FIGS. 14A and 14B illustrate an exemplary adapter that can connect to a wall socket. The wall socket 1460 of FIGS. 14A and 14B may be a wall socket, such as a NEMA-1 socket that includes only two pin (live and neutral) receptacles. The adapter 1400 of FIG. 14 allows plugs with three bars (live, neutral, and ground/Earth) to be plugged in similar to the way that conventional three pronged receptacles are used. Here, however grounding metal piece 1440 may be used to complete a ground connection. Note that grounding metal piece 1440 is similar to the grounding metal piece 710 of FIG. 7 which is L shaped. Note that grounding piece 1440 includes a screw hole 1040H that can receive screw 1435 to secure the plastic face plate 1460F to wall socket 1460. In such an instance screw 1435 may goes through screw hole 1445 and the metal bracket 1450.

Like the screw of FIG. 6, screw 1435 of FIG. 14A may be removed when removing face plate 1460F such that metal bracket 1450 may be installed behind face plate 1460F. Like the grounding adapter of FIG. 6, metal bracket 1450 may be connected to ground via a wire or metal piece. Screw 1435, grounding metal piece 1440, metal cover 1460F, and metal bracket 1450 may be used to form a sub-assembly that allows a TRO compliant socket or adapter to be plugged into receptacles 1455 in wall socket 1460, such that a ground connection can be coupled to Earth ping 1415 of plug 1410.

FIG. 14A includes TRO adapter 1400 that a bottom of the adapter that has an optional depression/recession 1430 in the middle that may be deep enough to cover grounding metal piece 1440 such that adapter 1400 can fit flush against cover plate 1460F without leaving a gap.

Adapter 1400 of FIG. 14 includes folding part 1425 that may be similar to the metal folding pieces of FIGS. 1 and 2 that may be folded to form plug bar 1425B and lip 1425C. The adapter 1440 of FIG. 14 may use folded metal pieces 1425 & 1440 such that plug bar 1420A and Earth pin 1415 of plug 1410 may be properly electrically connected to socket 1460.

Adapter 1400 may also include TRO socket that includes covers (not illustrated for clarity) that cover receptacles when plugs are not inserted into a respective socket.

FIG. 14B illustrates wall socket that has been adapted into a TRO compliant grounded wall socket. For clarity all of the parts included in FIG. 14B are not identified with reference numbers, yet FIG. 14B includes all of the features illustrated in FIG. 14A. Note that when adapter 1440 is connected to wall socket 1460 and electrical plug 1410 is plugged into adapter 1400, electrical contact is provided to plug bar 1420 via folding metal piece 1425. Note also that when plug 1410 is plugged into the assembly of FIG. 14B, that earth pin 1415 also contacts metal pieces 1440, such that a ground connection is provided to earth pin 1415 of plug 1410.

In certain instances adapter 1400 may include a screw hole that allows screw 1435 to be optionally replaced with a longer screw that could physically connect and retain adapter 1400 to wall socket 1460. In such an instance, the longer screw would pass through adapter 1400, like the screw illustrated in respect to FIG. 5A.

Figure 15:
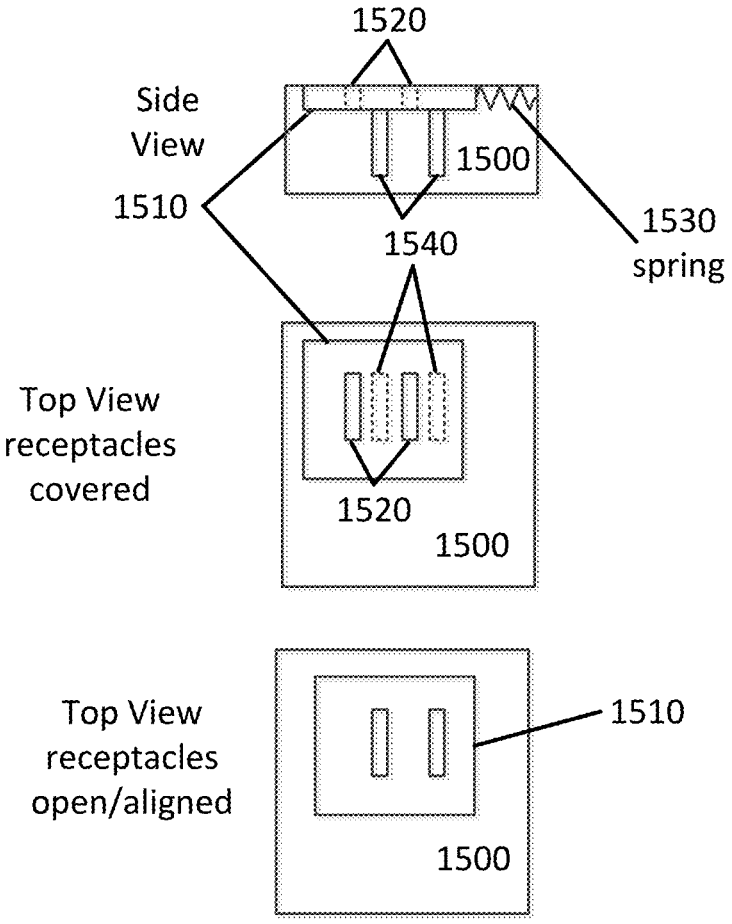
FIG. 15 illustrates parts that may be included in an exemplary spring loaded socket cover that may be used to cover receptacles consistent with the present disclosure.

FIG. 15 illustrates parts that may be included in an exemplary spring loaded socket cover that may be used to cover receptacles consistent with the present disclosure. FIG. 15 includes TRO socket 1500 that includes a spring loaded slide-able cover 1510, holes 1520, spring 1530, and receptacles 1520. Dashed lines in the side view illustrate holes in slide-able cover 1520 that are not aligned with receptacles 1540 because spring 1530 pushes slide-able cover 1510 into a position where holes 1520 are not aligned with receptacles 1540. In such a configuration a pointy object could not be directly pushed into a live/hot/electrically energized receptacle.

The top view with receptacles covered of FIG. 15 shows holes 1520 and receptacles 1540 illustrated with dashes lines because in this orientation, spring loaded cover 1510 covers receptacles 1540. The top view with receptacles open perspective of FIG. 15 illustrates an orientation where slide-able cover 1510 has been pushed to the right such that holes 1520 and receptacles 1540 align such that plug bars of a plug can be inserted into a socket because of the open/aligned orientation. Holes in the slide-able cover may be aligned with receptacles 1540 by a person pushing slide-able cover to the right to compress spring 1530. This would allow a plug to be installed into receptacles 1540. When that plug is removed, slide-able cover 1510 would be pushed back to the left as spring 1530 returns to its normal position, this allows for the receptacles to be covered whenever a plug is not inserted in a socket.

Figure 16:
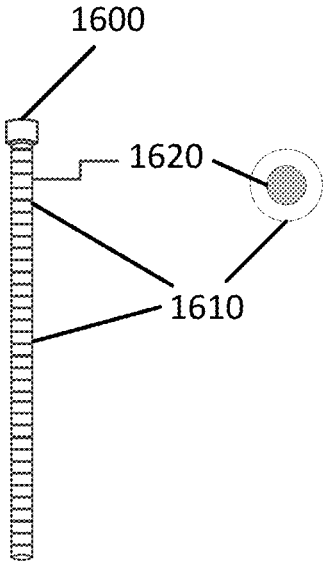
FIG. 16 illustrates a connecting piece that may be used to replace a screw.

FIG. 16 illustrates a connecting piece that may be used to replace a screw. Connecting piece 1600 may include ribbed portions 1610 and a center portion 1620. Connecting piece may be simply pushed into a screw hole of the present disclosure without requiring rotation as a screw does. In such an instance the ribbed portions may make contact with portions of a screw hole, for example the holes of 1440H and 1445 of FIG. 14 when ground connections are made. Ribbed portion 1610 may be flexible and may extend beyond central portion 1620 of connecting piece 1600. Connecting pieces may be flexible and electrically conductive allowing for them to be inserted or removed without rotation.

Figure 17:
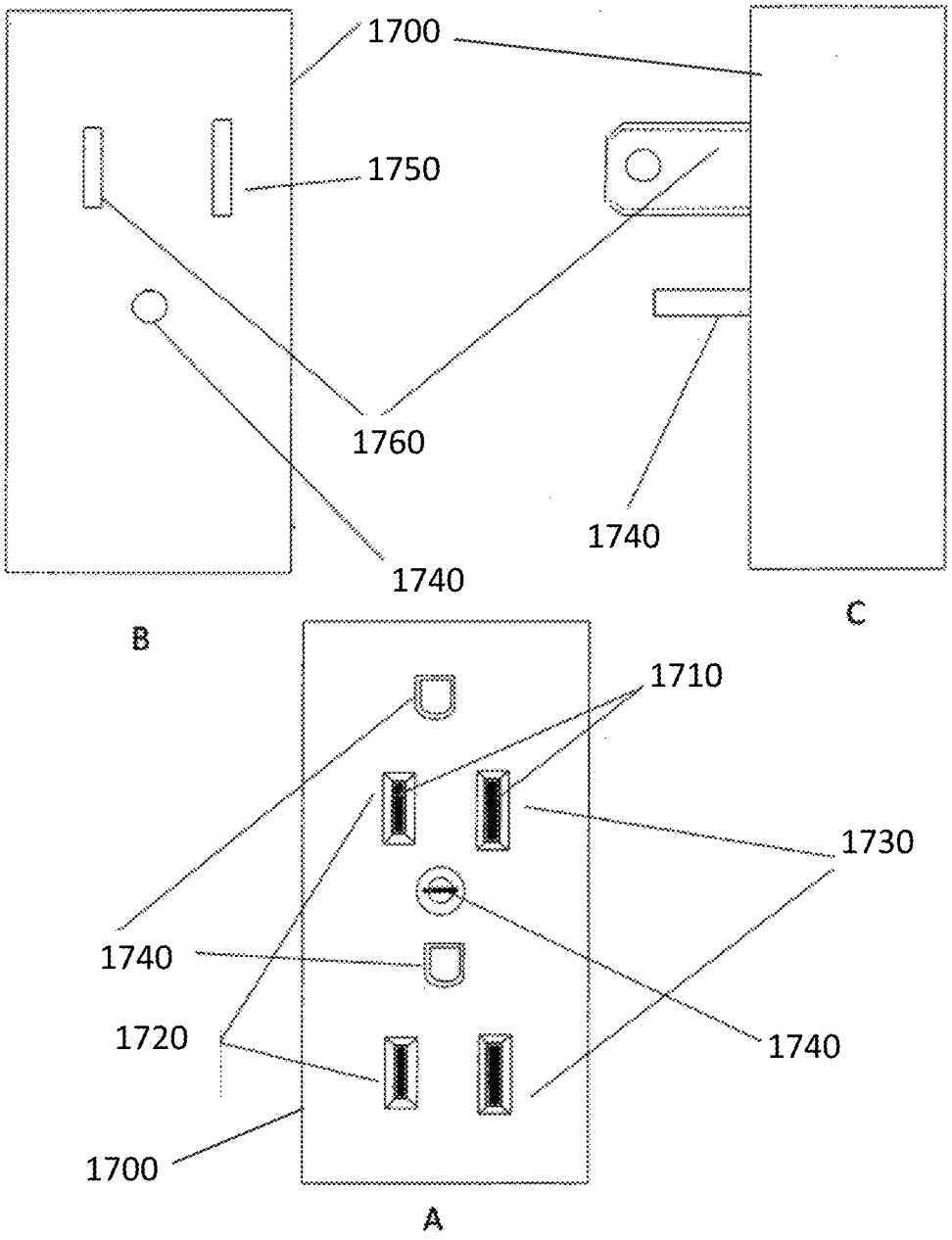
FIG. 17 illustrates three different views of an adapter that may convert a NEMA-1 wall socket to include the functionality of a tamper resistant socket.

FIG. 17 illustrates three different views of an adapter that may convert a NEMA-1 wall socket to include the functionality of a tamper resistant socket. FIG. 17 includes a first perspective A that illustrates a tamper resistant portion of the adapter/enclosure 1700 that includes protective screens 1710 that cover live inlet 1720 and neutral inlet 1730 connections. Perspective A also illustrates ground inlets 1740 and a screw 1750 that may be used to attach adapter 1700 to a wall socket.

Perspective B of adapter 1700 illustrates backside portion of the adapter that may plug into a NEMA-1 socket using neutral bar 1750 and live bar 1760. Perspective B of adapter 1700 also includes screw 1740. Perspective C of adapter 1700 illustrates neutral bar 1750, live bar 1760, and screw 1740.

Figure 18:
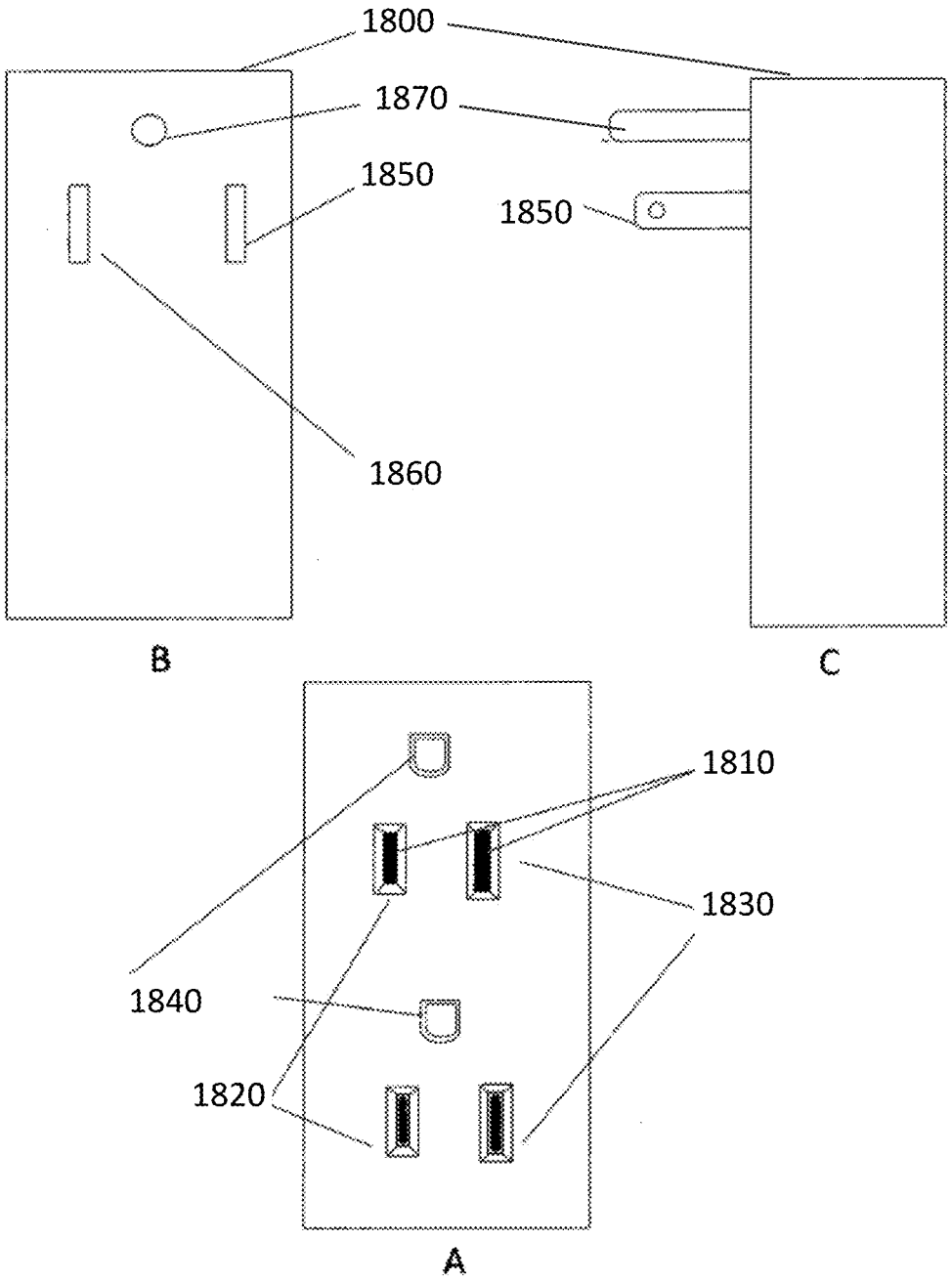
FIG. 18 illustrates three different views of an adapter that may convert a NEMA-5 wall socket to include the functionality of a tamper resistant socket.

FIG. 18 illustrates three different views of an adapter that may convert a NEMA-5 wall socket to include the functionality of a tamper resistant socket. FIG. 18 includes a first perspective A that illustrates a tamper resistant portion of the adapter/enclosure 1800 that includes protective screens 1810 that cover live inlet 1820 and neutral inlet 1830 connections. Perspective A also illustrates ground inlets 1840.

Perspective B of adapter 1800 illustrates backside portion of the adapter that may plug into a NEMA-5 socket using neutral bar 1850, live bar 1860, and ground pin 1870. Perspective C of adapter 1800 illustrates neutral bar 1850 and live bar 1860.

Figure 19:
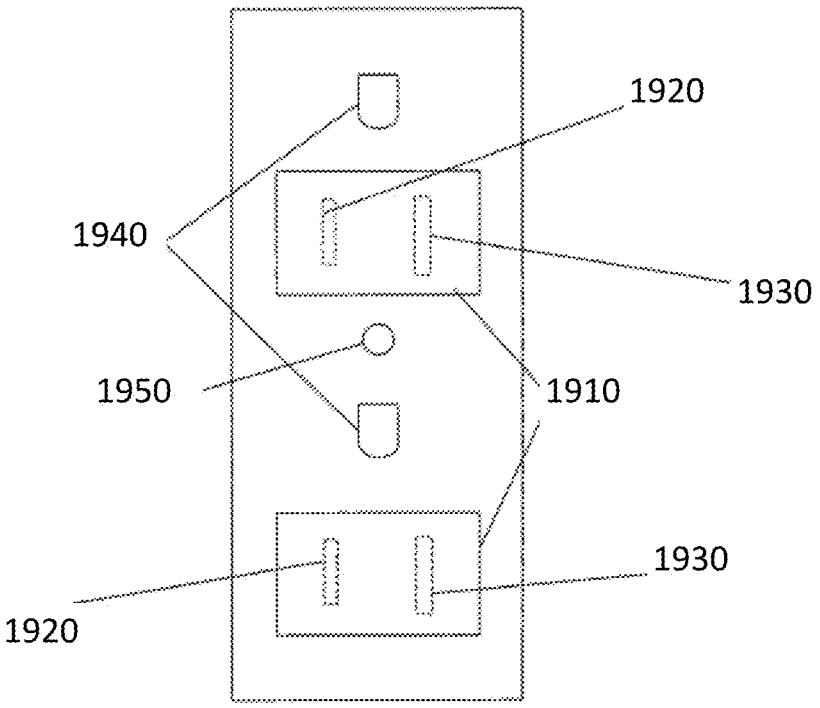
FIG. 19 illustrates an inside portion of an adapter consistent with the present disclosure.

FIG. 19 FIG. 19 illustrates an inside portion of an adapter consistent with the present disclosure. FIG. 19 includes protective screens 1910 that cover live inlets 1920, neutral inlets 1930, ground inlets 1940, and screw hole 1950.

The foregoing detailed description of the technology herein has been presented for purposes of illustration and description. It is not intended to be exhaustive or to limit the technology to the precise form disclosed. Many modifications and variations are possible in light of the above teaching. The described embodiments were chosen in order to best explain the principles of the technology and its practical application to thereby enable others skilled in the art to best utilize the technology in various embodiments and with various modifications as are suited to the particular use contemplated. It is intended that the scope of the technology be defined by the claim.

The invention claimed is:

1. A tamper resistant plug-able socket adapter apparatus comprising:

an enclosure;

a first electrically conductive protrusion that extends from a first surface of the enclosure;

an electrically conductive connecting protrusion that extends from the first surface;

a second electrically conductive protrusion that extends from the first surface, wherein the first and the second electrically conductive protrusions configured to mate with a first set of respective electrical socket conductors such that the first electrically conductive protrusion contacts a neutral contact of an electrical socket and the second electrically conductive protrusion contacts an electrically active contact of the electrical socket;

a receptacle disposed on a second surface of the enclosure, wherein the receptacle includes a first hole to receive a neutral plug bar of an electrical plug, a second hole to receive a live plug bar of the electrical plug, and a third hole to receive a ground pin of the electrical plug, wherein the neutral plug bar electrically connects to the first electrically conductive protrusion and the live plug bar of the electrical plug electrically connects to the second electrically conductive protrusion when the receptacle receives the electrical plug; and a first formed metallic piece configured to make direct physical contact with the ground pin of the electrical plug when the receptacle receives the neutral plug bar, the live plug bar, and the ground pin of the electrical plug, wherein at least a portion of the first formed metallic piece is perpendicular to the first and second electrically conductive protrusions when the first and the second electrically conductive protrusions mate with the first set of respective electrical socket conductors, and wherein the first formed metallic piece is also electrically connected to a grounded portion of the electrical socket via the electrically conductive connecting protrusion when the first and the second electrically conductive protrusions mate with the first set of respective electrical socket conductors of the electrical socket.

2. The adapter apparatus of claim 1, wherein the first formed metallic piece is configured to receive a screw that fits through a screw hole in the first formed metallic piece.

3. The adapter apparatus of claim 1, wherein the electrically conductive connecting protrusion includes a ribbed portion that contacts a hole in the first formed metallic piece.

4. The adapter apparatus of claim 1, wherein the electrically conductive connecting protrusion is perpendicular to the first surface of the enclosure, the electrically conductive connecting protrusion contacting the first formed metallic piece and a ground contact at the electrical socket.

5. The adapter apparatus of claim 1, wherein the first and the second electrically conductive protrusions are metallic.

6. The adapter apparatus of claim 1, further comprising a hole that extends from the first surface to the second surface, wherein the hole is configured to receive the electrically conductive connecting protrusion that also physically connects to the electrical socket.

7. The adapter apparatus of claim 1, wherein the electrically conductive connecting protrusion perpendicularly extends from the first surface of the enclosure and contacts a ground contact at the electrical socket.

8. The adapter apparatus of claim 1, further comprising a cover that flexibly covers at least the second hole, wherein the cover moves when the live plug bar is inserted into the second hole.

9. The adapter apparatus of claim 1, wherein the first and the second electrically conductive protrusions are compatible with a National Electrical Manufacturers Association (NEMA) socket.

10. The adapter apparatus of claim 9, wherein compatibility with the NEMA socket includes compatibility with a NEMA-1 socket.

11. The adapter apparatus of claim 9, wherein compatibility with the NEMA socket includes compatibility with a NEMA-5 socket.

12. The adapter apparatus of claim 1, wherein the enclosure is configured to enclose at least a portion of a tamper-resistant (TRO) socket.

13. The adapter apparatus of claim 12, wherein the enclosure is configured to enclose the portion of the TRO socket that electrically connects to the electrical socket.

14. The adapter apparatus of claim 8, wherein the cover and the electrical socket are each configured to receive more than one electrical plug.

15. The adapter apparatus of claim 1, further comprising a fourth and a fifth electrically conductive protrusions that extend from the first surface of the enclosure and that are separate from the first and the second electrically conductive protrusions, wherein the fourth and the fifth electrically conductive protrusions mate with a second set of respective electrical socket conductors such that the fourth electrically conductive protrusion contacts a neutral contact of the second set of respective electrical socket conductors and the fifth electrically conductive protrusion contacts a second electrically active contact of the second set of respective electrical socket conductors.

16. The adapter apparatus of claim 1, wherein the first and the second electrically conductive protrusions are compatible with a 110 volt alternating current voltage source.

17. The adapter apparatus of claim 1, wherein the first electrically conductive protrusion has a shape that is compatible with the neutral plug bar of the electrical plug.

18. The adapter apparatus of claim 17, wherein the second electrically conductive protrusion has a shape that is compatible with the live plug bar of the electrical plug.

19. The adapter apparatus of claim 8, wherein the cover is coupled to a spring that causes the cover to close when the plug is removed.

* * * * *